US009010669B2

(12) United States Patent
Priebe et al.

(10) Patent No.: US 9,010,669 B2
(45) Date of Patent: Apr. 21, 2015

(54) PILL CRUSHER ASSEMBLY AND METHODS

(71) Applicant: Apothecary Products, Inc., Burnsville, MN (US)

(72) Inventors: Robert N. Priebe, Bloomington, MN (US); Terrance O. Noble, Burnsville, MN (US)

(73) Assignee: Apothecary Products, LLC, Burnsville, MN (US)

( * ) Notice: Subject to any disclaimer, the term of this patent is extended or adjusted under 35 U.S.C. 154(b) by 0 days.

(21) Appl. No.: 14/249,954

(22) Filed: Apr. 10, 2014

(65) Prior Publication Data

US 2014/0217209 A1 Aug. 7, 2014

Related U.S. Application Data

(62) Division of application No. 13/469,659, filed on May 11, 2012, now Pat. No. 8,720,807.

(51) Int. Cl.

| | |
|---|---|
| ***A47J 17/00*** | (2006.01) |
| ***A61J 7/00*** | (2006.01) |
| ***B02C 19/08*** | (2006.01) |

(52) U.S. Cl.

CPC ..... *A61J 7/0007* (2013.01); *B02C 19/08* (2013.01); *A61J 7/00* (2013.01)

(58) Field of Classification Search

CPC ..... A61J 7/00; A61J 7/0007; B02C 1/00; B02C 19/08

USPC ..... 241/DIG. 27, 169, 169.1, 270, 30

See application file for complete search history.

(56) References Cited

U.S. PATENT DOCUMENTS

| | | | | |
|---|---|---|---|---|
| 2,602,596 | A | 7/1952 | Jones et al. | |
| 4,209,136 | A | 6/1980 | Linden et al. | |
| 4,366,930 | A | 1/1983 | Trombetti, Jr. | |
| 4,765,549 | A | 8/1988 | Sherman | |
| 4,967,971 | A | 11/1990 | Smith | |
| 5,322,227 | A | 6/1994 | Fiocchi | |
| 5,533,683 | A | 7/1996 | Fay et al. | |
| 6,508,424 | B1 | 1/2003 | Marshall | |
| 7,735,763 | B2 | 6/2010 | Bell et al. | |
| 7,823,819 | B1 | 11/2010 | Marshall | |
| 7,886,999 | B2 | 2/2011 | Ruzycky | |
| 8,033,488 | B2 | 10/2011 | Grah | |
| 8,162,247 | B2 | 4/2012 | Faulker | |
| 8,720,807 | B2 * | 5/2014 | Priebe et al. | 241/169 |
| 2009/0224088 | A1 | 9/2009 | Ruzycky | |

OTHER PUBLICATIONS

Photos of prior art pill crushers, in public use before May 11, 2012.

* cited by examiner

*Primary Examiner* — Faye Francis

(74) *Attorney, Agent, or Firm* — Merchant & Gould P.C.

(57) ABSTRACT

A pill crusher includes a base and a handle. The base has a bottom resting surface that includes an at least partially molded friction-enhancing portion. The handle includes an upper region, a gripping region, and a column. The gripping region includes an at least partially molded friction-enhancing portion. A method of crushing a pill includes placing a pill within a pill chamber, inserting a column into the pill chamber, and then crushing the pill by exerting force on the pill by the column. The handle and the base include at least partially molded friction-enhancing portions.

7 Claims, 9 Drawing Sheets

PILL CRUSHER ASSEMBLY AND METHODS

CROSS REFERENCE TO RELATED APPLICATION

This application is a divisional of application Ser. No. 13/469,659, filed May 11, 2012, which application is incorporated herein by reference in its entirety.

TECHNICAL FIELD

This disclosure concerns assemblies and methods for crushing a pill or tablet, the type used for medicinal purposes.

BACKGROUND

Pill or tablet crushers are needed to assist with people or animals who are unable or unwilling to swallow whole pills. A variety of pill crushers have been used in the past. Such prior art pill crushers have a number or problems. One such problem is prior art pill crushers have been awkward to operate and/or hold or control, especially by those who have a weak hand or grip strength. Another problem is that some of the prior art pill crushers have sharp or otherwise unprotected edges that can lead to tears in skin, especially for elderly skin that has lost its flexibility. Improvements are desirable.

SUMMARY

To address the problems in the prior art, and meet other objectives, a pill crusher is provided including a base and a handle. The base includes a bottom resting surface, an opposite top surface, and a side edge between the bottom resting surface and the top surface. The bottom resting surface includes an at least partially molded friction-enhancing portion. A surrounding wall extends from the top surface and defines a pill chamber. The handle includes an upper region, a gripping region, and a column. The gripping region extends from and surrounds the upper region. The gripping region includes an at least partially molded friction-enhancing portion. The column has a free end for crushing a pill within the pill chamber. The column extends from the upper region and is sized to fit within the pill chamber.

In another aspect, a method of crushing a pill includes a step of providing a base. The base has a bottom resting surface, an opposite top surface, and a side edge between the bottom resting surface and the top surface. The bottom resting surface includes an at least partially molded friction-enhancing portion. A surrounding wall extends from the top surface and defines a pill chamber. The method also includes placing a pill within the pill chamber. Next, a handle is provided including an upper region, a gripping region including an at least partially molded friction-enhancing portion, and a column having a free end extending from the upper region. The method includes inserting the column into the pill chamber, and then crushing the pill by exerting force on the pill by the free end of the column.

DETAILED DESCRIPTION

In accordance with principles of this disclosure, a pill crusher that addresses the problems in the prior art is provided. The pill crusher allows operation by those who have a weak hand or grip strength. The pill crusher does not have sharp or unprotected edges that can lead to tears in skin, especially elderly skin. A first embodiment of a pill crusher is shown in FIG. 1 generally at 30.

Figure 1:
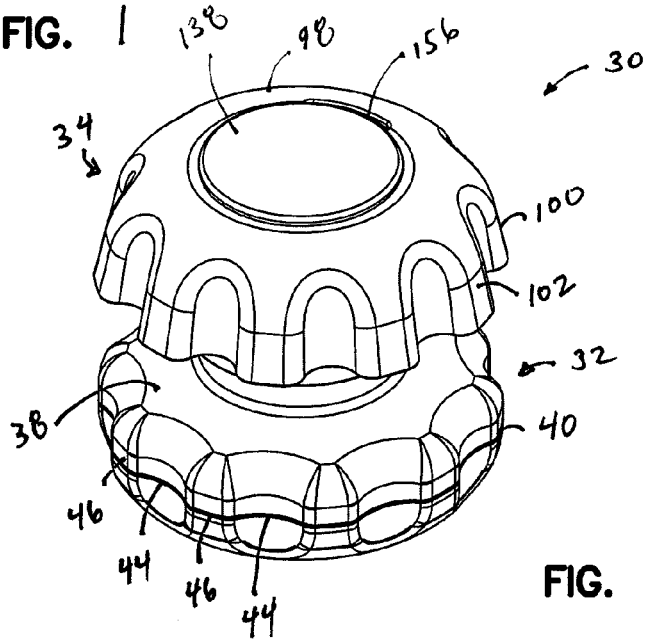
FIG. 1 is a perspective view of one embodiment of a pill crusher, constructed in accordance with principles of this disclosure.
Figure 2:
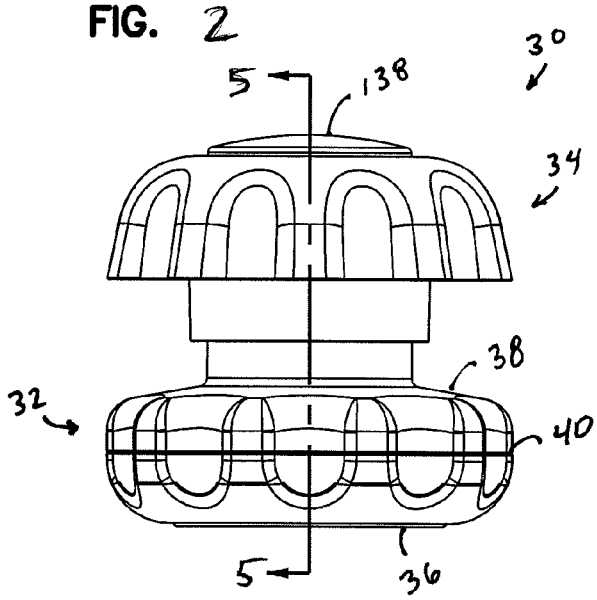
FIG. 2 is a side elevational view of the pill crusher of FIG. 1.
Figure 3:
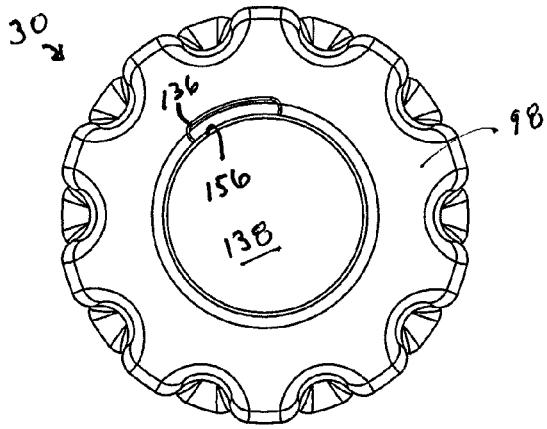
FIG. 3 is a top view of the pill crusher of FIG. 1.

In reference to FIGS. 1 and 2, the pill crusher 30 includes a base 32 and a handle 34. The base 32 and the handle 34 engage and cooperate to allow for grinding or crushing a pill or tablet placed between them. This is explained further below.

Figure 5:
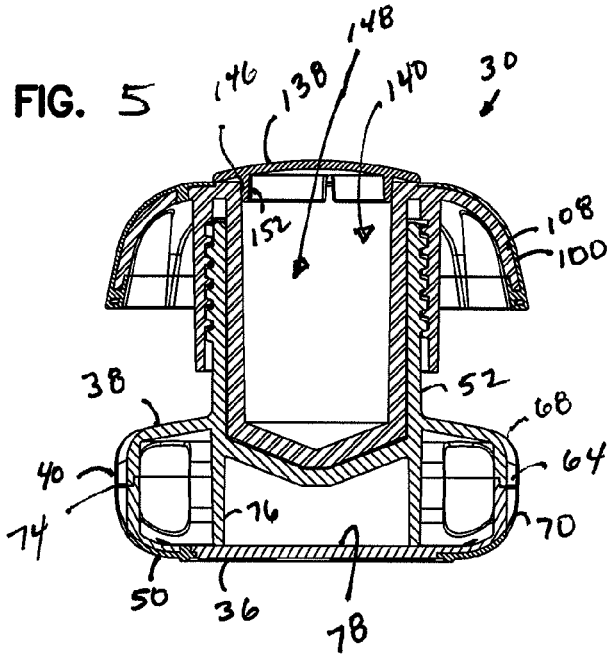
FIG. 5 is a cross sectional view of the pill crusher of FIG. 1, the cross section being taken along the line 5-5 of FIG. 2.

In reference to FIGS. 2 and 5, in the embodiment depicted in the drawings, the base 32 includes a bottom resting surface 36. The bottom resting surface 36 operates as a surface that the entire pill crusher 30 can rest upon, if the pill crusher 30 is going to be placed against another surface during operation. For example, if the pill crusher 30 is going to be placed on a tabletop or counter surface, the pill crusher 30 will be oriented so that the bottom resting surface 36 is the surface that will touch and be against the tabletop or counter.

Figure 9:
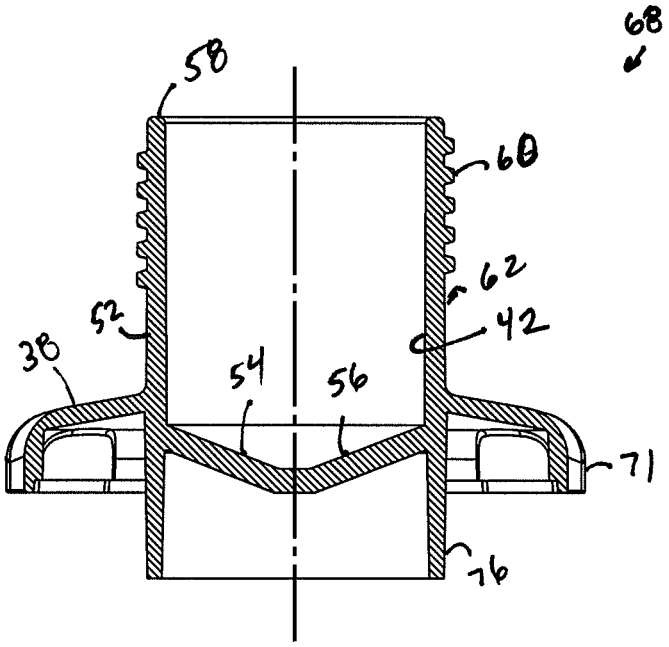
FIG. 9 is a cross sectional view of the upper base of FIG. 6, the cross section being taken along the line 9-9 of FIG. 7.

The base 32 has a top surface 38 that is opposite from the bottom resting surface 36. Between the bottom resting surface 36 and the top surface 38 is a side edge 40. In preferred implementations, the base top surface 38 and at least a portion of the base side edge 40 is transparent. The transparent nature of the top surface 38 and at least a portion of the side edge 40 allows for visual inspection of a pill chamber 42 (FIG. 9).

Figure 6:
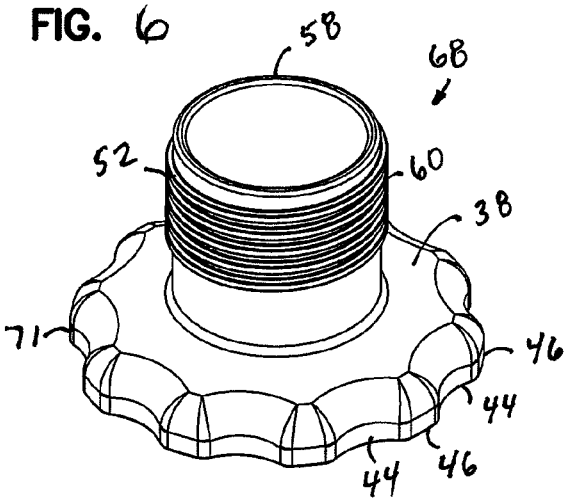
FIG. 6 is a perspective view of an upper base that is part of the pill crusher of FIG. 1.
Figure 7:
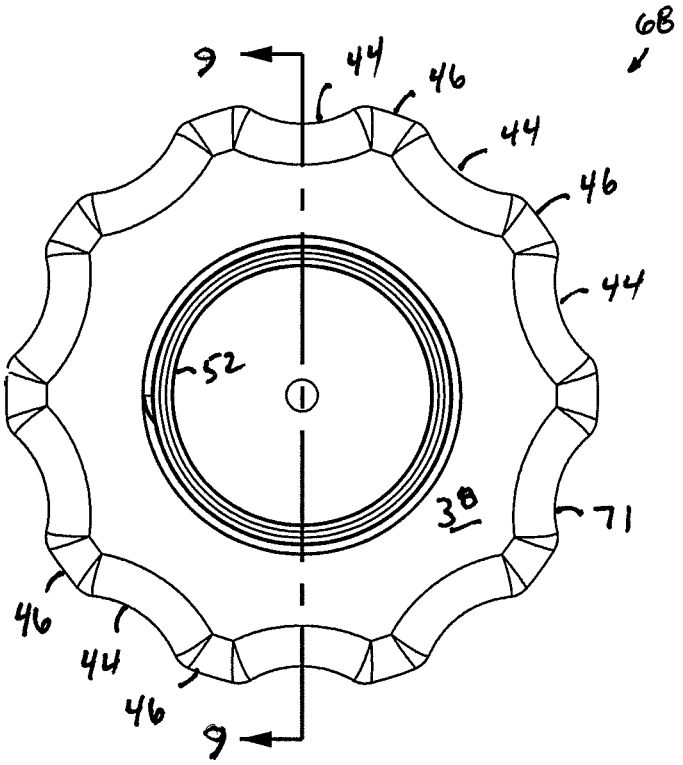
FIG. 7 is a top view of the upper base of FIG. 6.
Figure 8:
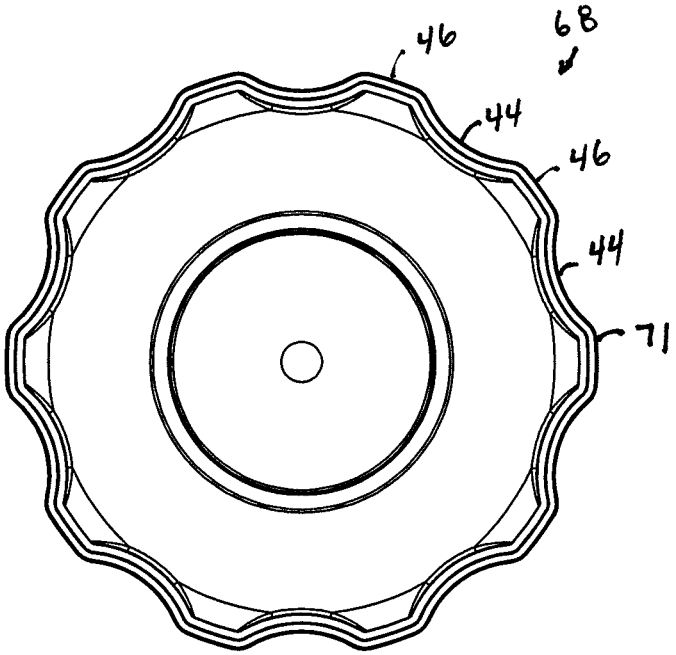
FIG. 8 is a bottom view of the upper base of FIG. 6.

In some embodiments, it can be preferred to have the side edge 40 of the base 32 in a shape that allows for easier gripping. In situations in which the pill crusher 30 is not placed on the bottom resting surface 36, but instead is held in a person's hand, it can have advantages to have the side edge 40 be in a shape that allows for enhanced gripping. For example, the side edge 40 can be wave-like, or undulated. In the examples shown in FIGS. 1, 6, and 7, the side edge 40 includes a plurality of evenly spaced concave recesses 44 separated by a plurality of evenly spaced projections 46. This shape allows for, for example, the fingers of a person to fit within the recesses 44, while the palm of the hand is against the bottom resting surface 36. With the fingers within the recesses 44, separated by projections 46, an enhanced and better grip on the pill crusher 30 is provided, as compared to a pill crusher that does not have this type of shape of side edge 40.

The bottom resting surface 36 includes an at least partially molded friction-enhancing portion 48. This friction-enhancing portion 48 helps to steady the pill crusher 30 against the surface it is resting upon, such as a tabletop, counter top, or the palm of a hand.

Figure 14:
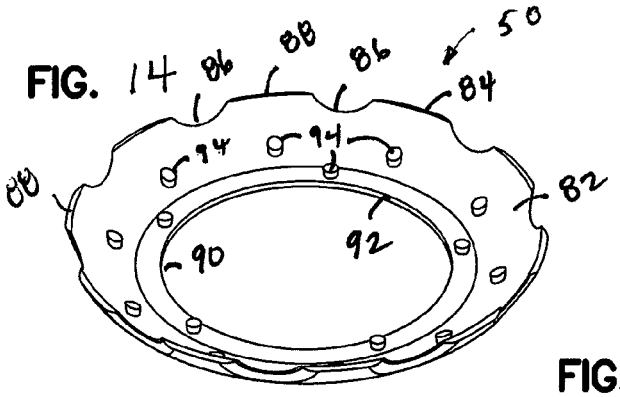
FIG. 14 is a perspective view of an overmold used in the lower base of the pill crusher of FIG. 1.
Figure 15:
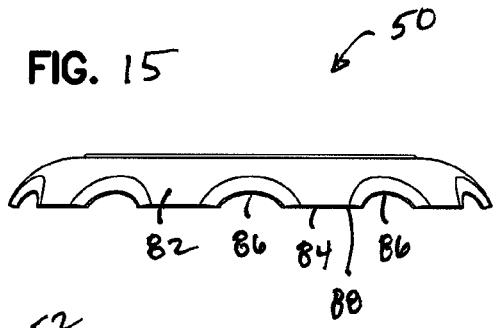
FIG. 15 is a side view of the overmold of FIG. 14.

In one non-limiting example shown in the drawings, the friction-enhancing portion 48 is formed from an overmold 50 (FIGS. 14 and 15). The overmold 50 can be made from at least one of a thermoplastic elastomer or thermoplastic rubber. These materials will allow for friction between the bottom resting surface 36 and whatever the pill crusher 30 is resting against in a manner to prevent slipping. Further, if the pill crusher 30 is being held by hand, the material of the overmold 50 will provide for a relatively soft and comfortable engagement so as to prevent cutting, abrasions, or tearing of skin of the hand.

The base 32 can have a surrounding wall 52 extending from the top surface 38. The surrounding wall 52 defines the pill chamber 42 (FIG. 9). In one embodiment, the surrounding wall 52 forms a cylinder shape. In FIG. 5, the surrounding wall 52 can be seen spaced from the side edge 40, and in one example, centered there within.

In reference to FIG. 9, the pill chamber 42 can be shaped to help enhance the crushing or grinding of a pill. For example, the pill chamber 42 may include a conically shaped grinding surface 54. The conically shaped grinding surface 54 is defined by a sloped surface 56 sloping away from and downwardly from the surrounding wall 52. Opposite from the grinding surface 54 is a free end 58 of the surrounding wall 52. As can also be seen in FIG. 9, in the particular embodiment shown, the surrounding wall 52 includes threads 60 along an external surface 62 of the surrounding wall 52. The threads 60 allow for selected threaded connection with the handle 34, as to be discussed further below.

Figure 4:
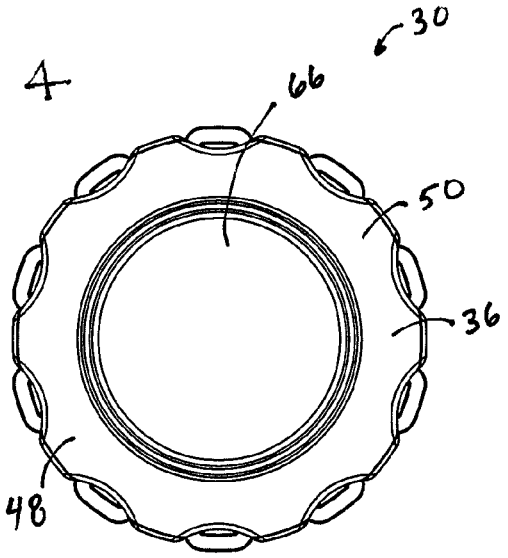
FIG. 4 is a bottom view of the pill crusher of FIG. 1.

While a variety of ways are contemplated in providing the base 32, in one embodiment, the base 32 includes an integral rigid member 64 (FIG. 5) having the overmold 50 (FIGS. 14 and 15) molded onto the rigid member 64. FIG. 4 is a bottom view of the pill crusher 50, and in FIG. 4, it can be seen that in one non-limiting example, the friction-enhancing portion 48, formed in one example from overmold 50, frames a transparent window 66 in the bottom resting surface 36. This window 66 is formed from a transparent portion of the rigid member 64 and allows for visual inspection of the pill chamber 42. In preferred embodiments, at least the grinding surface 54 of the pill chamber 42 is also made from transparent material. As such, a user can look through the window 66 and view the grinding surface 54 of the pill chamber 42, which allows for inspection of the condition of the pill being crushed.

Figure 10:
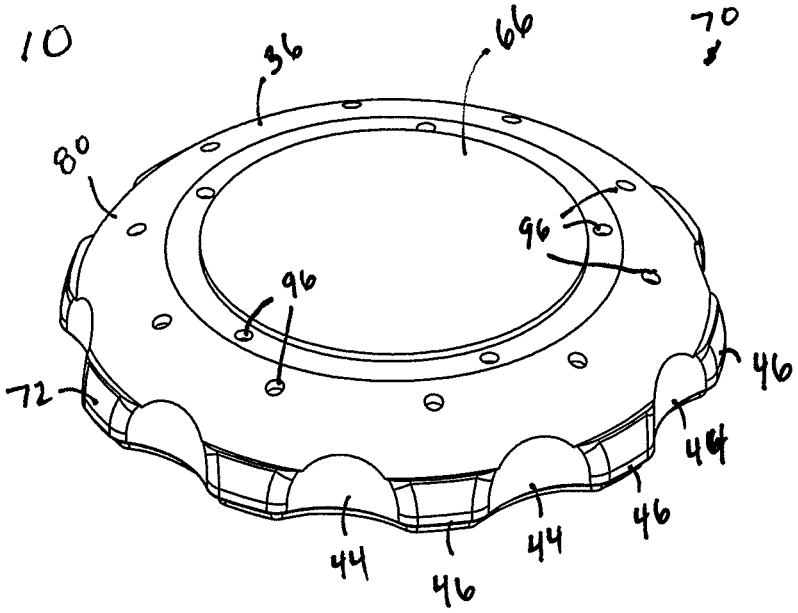
FIG. 10 is a perspective view of a lower base that is part of the pill crusher of FIG. 1.
Figure 11:
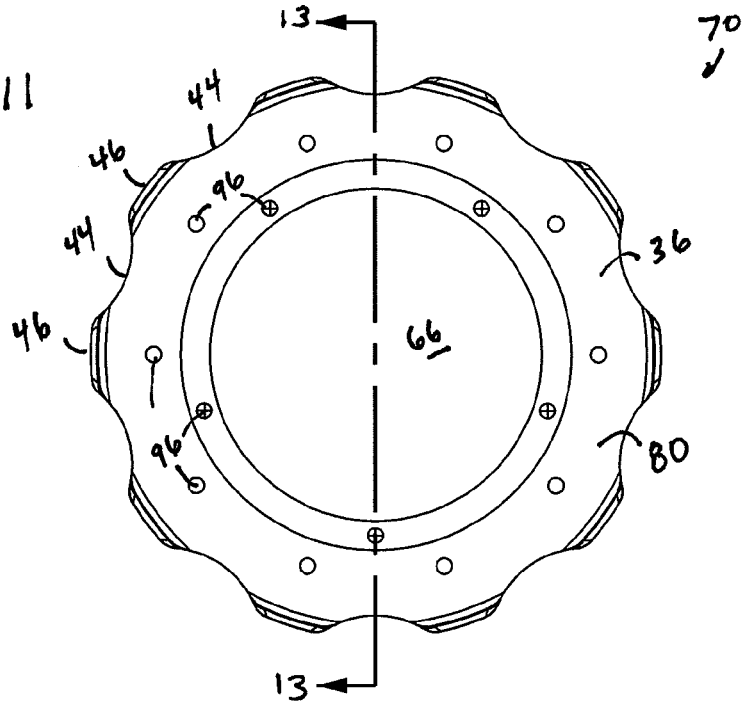
FIG. 11 is a top view of the lower base of FIG. 10.
Figure 12:
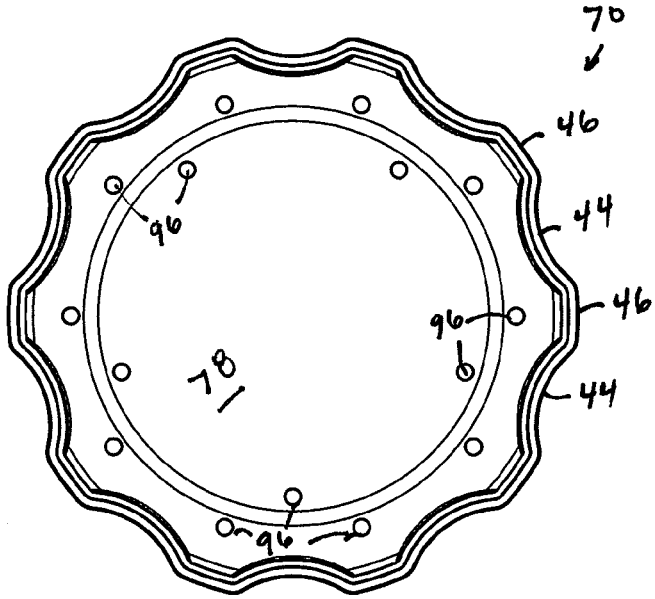
FIG. 12 is a bottom view of the lower base of FIG. 10.

In one nonlimiting example, the rigid member 64 is made from an upper base piece 68 (FIGS. 6-9) and a lower base piece 70 (FIGS. 10-13). The upper base piece 68 includes the surrounding wall 52 and top surface 38. A side edge 71 is also defined by the upper base piece 68. The lower base piece 70 defines the bottom resting surface 36 and the window 66. FIG. 11 shows a bottom view of the lower base piece 70, while FIG. 12 shows a top view of the lower base piece 70.

Figure 13:
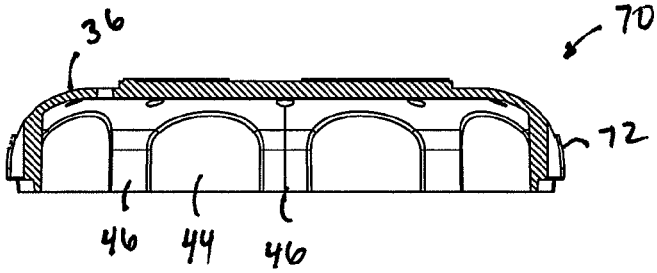
FIG. 13 is a cross sectional view of the lower base of FIG. 10, the cross section being taken along the line 13-13 of FIG. 11.

As can be seen in FIGS. 5, 10, and 13, the lower base piece 70 is cup shaped with a side edge 72 extending at a radius from the bottom resting surface 36.

Together the side edge 71 of the upper base piece 68 and the side edge 72 of the lower base piece 70 are joined together in a permanent joint 74 (FIG. 5) and together form the overall side edge 40 of the base 32. As can also be appreciated by reviewing FIGS. 6 and 9, the combination of the top surface 38 of the base 32 and the side edge 71 of the upper base piece 68 forms a cup shape, with the side edge 71 being radiused and extending away from the top surface 38. The side edge 71 also surrounds and circumscribes the surrounding wall 52, while being spaced from the wall 52. The upper base piece 68 further includes a section 76 (FIG. 9) of the wall 52, which extends or projects below the grinding surface 54. This section 76 engages against an inside surface 78 (FIGS. 5 and 12) of the lower base piece 70. This can help to provide for a stronger base 38.

In FIGS. 14 and 15, the overmold 50 is depicted. The overmold 50 has a general shape that matches the general cup shape of the outside surface 80 of the lower base piece 70. The overmold 50 includes a generally circular and radiused portion 82. The portion 82 includes a first rim 84. In this example embodiment, the first rim 84 has a plurality of concave sections 86 separated by a plurality of projecting sections 88. In some embodiments, it can be helpful to match the shape of the first rim 84 to the shape of the side edge 72 of the lower base piece 70 to help enhance friction between the bottom resting surface 36 and whatever it is engaged (a hand or a tabletop). The portion 82 also has a second rim 90 which is circumscribed by the first rim 84. The second rim 90, in the embodiment shown, has generally a circular shape. It defines an opening 92 which frames the window 66 in the bottom resting surface 36. Between the second rim 90 and the first rim 84, the portion 82 is radiused.

In FIG. 14, it can be seen how in the non-limiting example shown, the overmold 50 includes a plurality of projections 94 extending from the portion 82. These projections 94 are received within apertures 96 in the lower base piece 70. This helps to provide a secured attachment when molding the overmold 50 to the lower base piece 70. A variety of techniques are usable to secure the overmold 50 to the lower base piece 70, and this is just one example.

In one example, the upper base piece 68 and lower base piece 70 are made from a nonmetal material that is inexpensive, hard, and stiff, such as a clear polystyrene.

In reference again to FIG. 1, the handle 34 of the pill crusher 30 includes an upper region 98. Extending from and surrounding the upper region 98 is a gripping region 100. The gripping region 100 includes an at least partially molded friction-enhancing portion 102.

Figure 21:
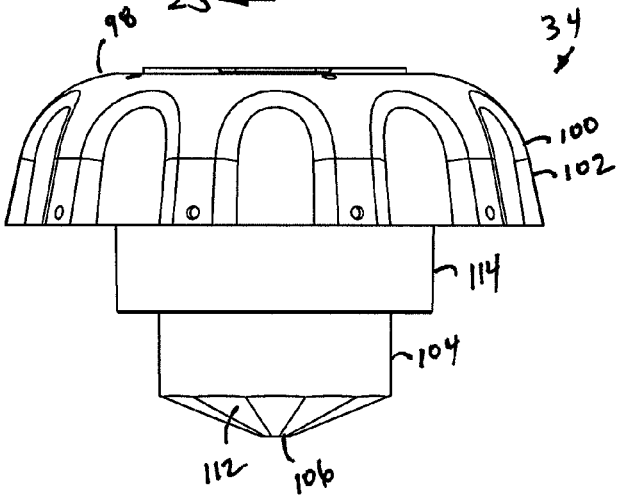
FIG. 21 is a side view of the main handle of FIG. 19.
Figure 23:
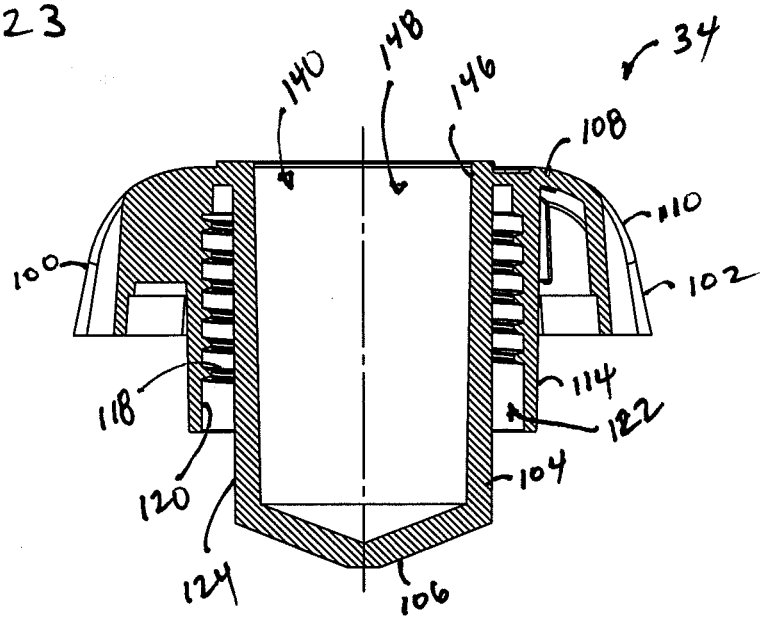
FIG. 23 is a cross sectional view of the main handle of FIG. 19, the cross section being taken along the line 23-23 of FIG. 20.

The handle 34 includes a column 104 (FIGS. 21 and 23). The column 104, in the one depicted, has a free end 106 for crushing a pill within the pill chamber 42. In the example shown, column 104 extends from the upper region 98. In preferred embodiments, the column 104 is sized to fit within the pill chamber 42.

Figure 24:
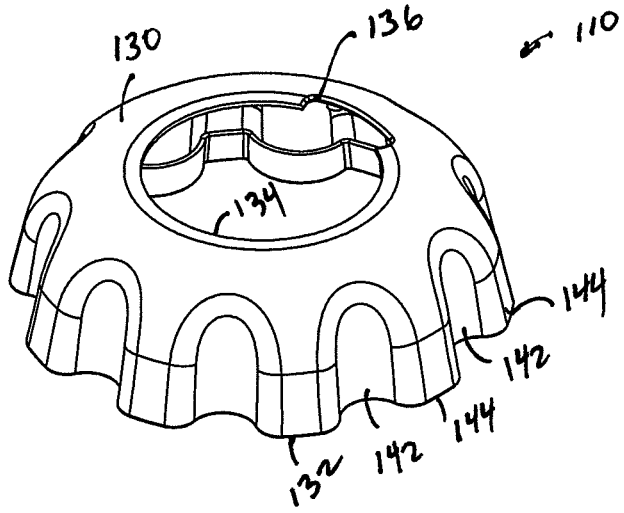
FIG. 24 is a perspective view of an overmold for the main handle used in the pill crusher of FIG. 1.
Figure 25:
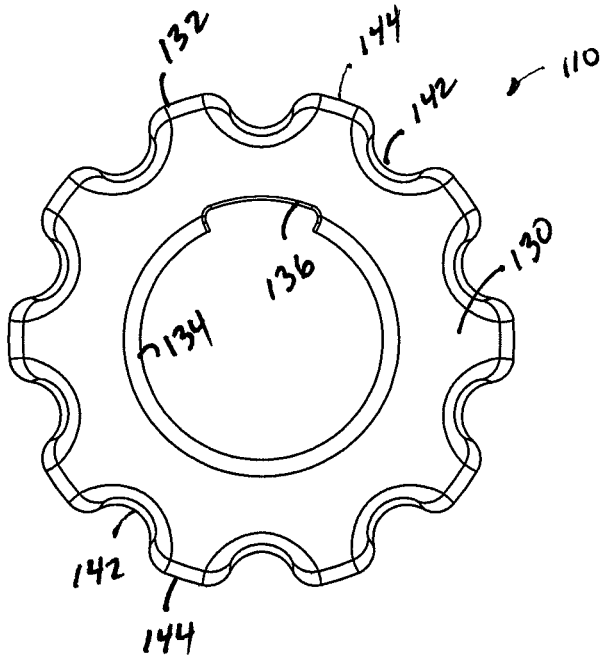
FIG. 25 is a top view of the overmold of FIG. 24.
Figure 26:
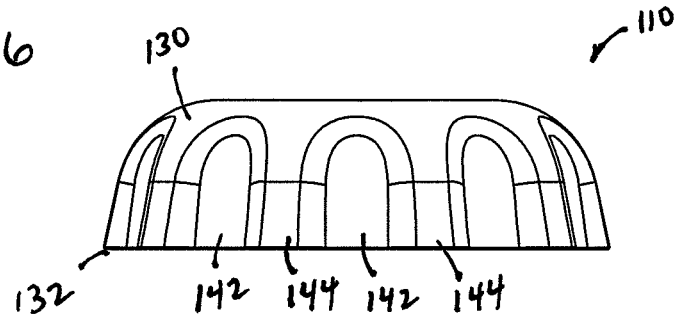
FIG. 26 is a side view of the overmold of FIG. 24.

While a variety of implementations are possible, in the example embodiment shown, the handle 34 includes an integral rigid member 108 (FIG. 23) with an overmold 110 forming the at least partially molded friction-enhancing portion 102 of the gripping region 100. One example of an overmold 110 is shown in FIGS. 24-26.

As can be seen in FIG. 21, the gripping region 100 surrounds and is spaced from the column 104.

The free end 106 of the column 104, in one embodiment, is faceted 112 (FIG. 21). In one preferred example, the free end 106 is generally conically shaped to crush a pill against the grinding surface 54 of the pill chamber 42.

In one nonlimiting example, the handle 34 includes a wall member 114 spaced form and surrounding the column 104.

Figure 22:
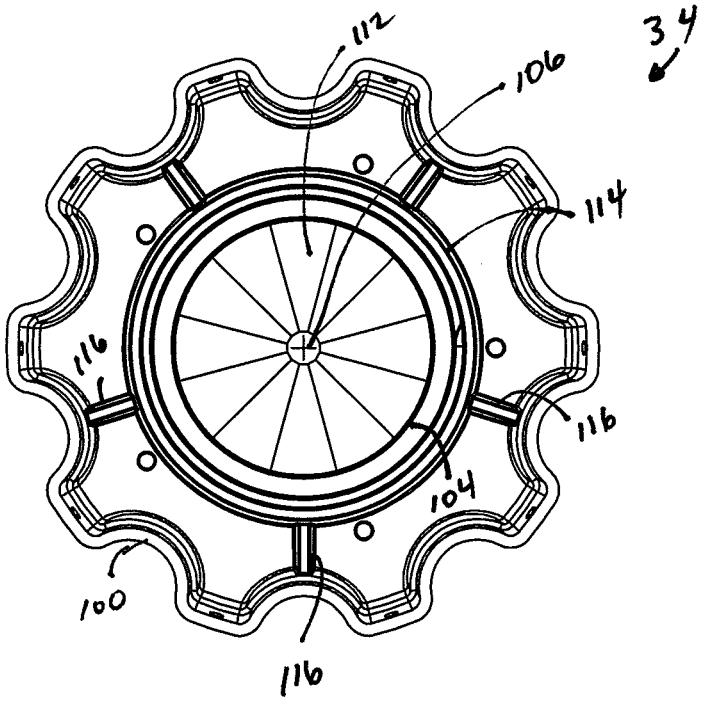
FIG. 22 is a bottom view of the main handle of FIG. 19.

In one embodiment, the handle 34 may include a plurality of ribs 116 (FIG. 22) extending between and connecting the wall member 114 and the gripping region 100. The ribs 116 can help to strengthen the overall handle 34.

As mentioned previously, the external surface 62 of the base 32 includes threads 60. Mating with a thread 60 are threads 118 (FIG. 23) along an internal side 120 of the wall member 114. As can be seen in FIG. 23, there is a gap 122 between the internal side 120 of the wall member 114 and an external surface 124 of the column 104. This gap 122 accommodates and receives the surrounding wall 52 of the base 32. The threads 60 of the base 32 and the threads 118 of the handle 34 mate. As the handle 34 is rotated and threadably connected to the base 32, the column 104 is received within and moves downwardly into the pill chamber 42. The free end 106 of the column 104 will engage a pill within the pill chamber 42. The free end 106, including the faceted surface 112 will grind against the pill, which is trapped between the column 104 and the grinding surface 54. The circular motion of the handle 34, as it is threaded within the base 32 provides torque and force against the pill to be crushed.

In reference again to FIGS. 19 and 20, the gripping region 100 of the handle 34 includes a plurality of evenly spaced concave recesses 126 separated by a plurality of even spaced projections 128, in this non-limiting example. This shape to the gripping region 100 helps to enhance the grip of a hand because, for example, the recesses 126 allow for fingers to be placed, while the projections 128 help to hold the figures within the recesses 126.

In the nonlimiting example shown, the at least partially molded friction-enhancing portion 102 covers substantially all of the evenly spaced concave recesses 126 and evenly spaced projections 128. In one example, the friction-enhancing portion 102 is formed by the overmold 110. The overmold 110 can be made from a material that does enhance friction and gripping, such as a thermoplastic elastomer or thermoplastic rubber.

As can be seen in FIGS. 24-26, the overmold 110 includes a mold portion 130 with an outside rim 132 and an inside rim 134. The mold portion 130 forms the general outside shape as the upper region 98 and gripping region 100 of the rigid member 108. It is generally cup shaped and on a radius as it extends between the inside rim 134 and outside rim 132. The inside rim 134 is generally circular shaped, including a notch 136 to accommodate access to a lid 138 (FIGS. 16-18) for a pill holder 140 (FIGS. 5 and 23). The pill holder 140 is described further below.

The outside rim 132 has a shape that generally matches the shape of the gripping region 100 of the rigid member 108. As such, it has a plurality of evenly spaced concave recesses 142 separated by evenly spaced projections 144.

As mentioned above, in some arrangements, the pill crusher 30 can include a pill holder 140 (FIG. 5). In this embodiment, the pill holder 140 is shown within the handle 34. The pill holder 140 has an access opening 146 (FIGS. 5 and 23) in the upper region 98 of the handle 34. Lid 138 is provided to cover the opening 146. In the embodiment shown, the lid 138 is removable from the opening 146. This allows access to the pill holder 140. As can be seen from the embodiment of FIGS. 5 and 23, in the example implemented, the pill holder 140 is defined by an open internal volume 148 of the column 104.

Figure 16:
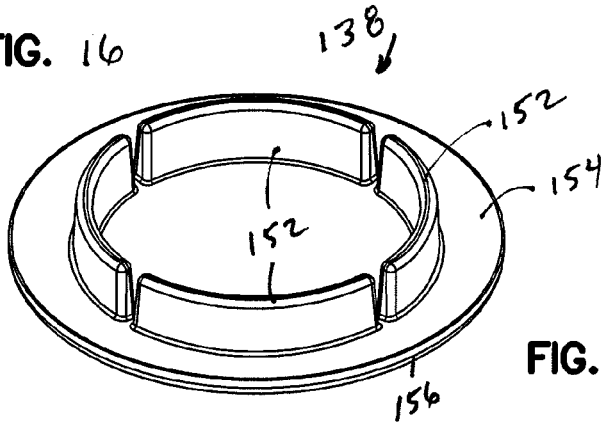
FIG. 16 is a perspective view of a pill compartment cover used with the pill crusher of FIG. 1.
Figure 17:
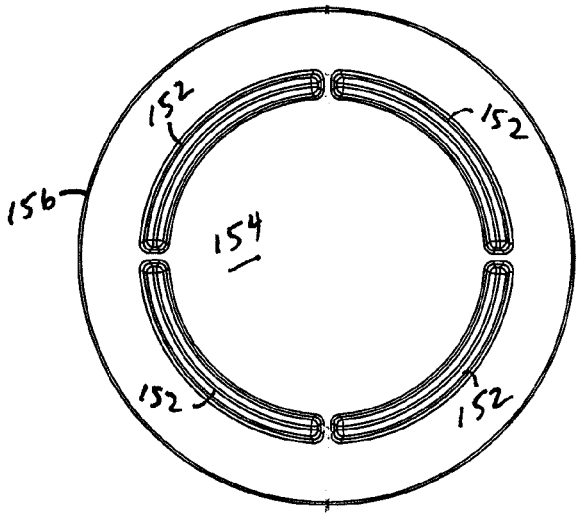
FIG. 17 is a top view of the pill compartment cover of FIG. 16.
Figure 18:
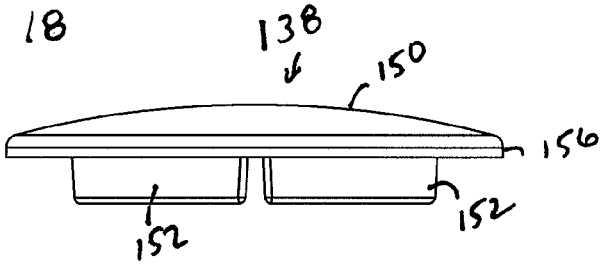
FIG. 18 is a side view of the pill compartment cover of FIG. 16.
Figure 19:
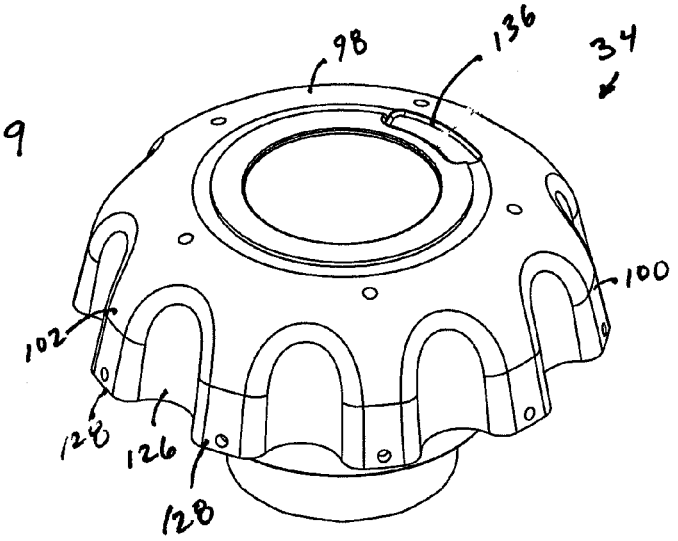
FIG. 19 is a perspective view of the main handle of the pill crusher of FIG. 1.
Figure 20:
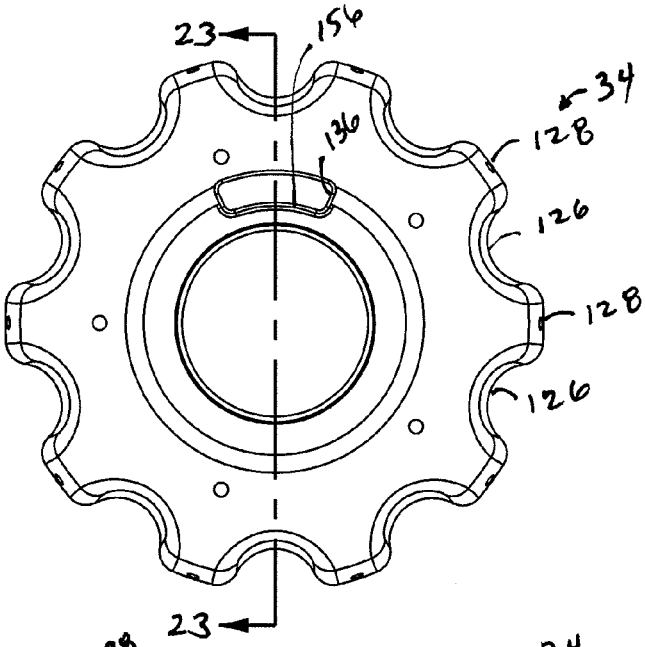
FIG. 20 is a top view of the main handle of FIG. 19.

The lid 138, as can be seen in FIGS. 16-18, has a generally dome shaped upper surface 150. On an opposite surface, there are spaced segments 152 projecting from the lower surface 154. The segments 152 engage the internal wall of the column 104 in a manner that the lid 138 is held within the access opening 146. In FIGS. 19 and 20, it can be seen how the side notch 136 allows for access, such as with a thumb or finger, to the outer rim 156 of the lid 138. This allows for removal of the lid 138 from the handle 34.

In use, the pill crusher 30 can be used to crush or grind a pill or tablet. The pill to be crushed is placed within the pill chamber 42. The column 104 of the handle 34 is inserted into the pill chamber 42, and the pill is crushed by exerting force on the pill by the free end 106 of the column 104.

In one example, the pill is crushed by rotating the handle 34 relative to the base 32. In one example, the threads 118 and the threads 60 are mated or connected, while the handle 34 is rotated. As the handle 34 is rotated, the threaded connection will move the column 104 axially toward the grinding surface 54 of the pill chamber 42. Further rotation of the handle 34 will exert greater force on the pill, which is trapped between the grinding surface 54 and the free end 106 of the column 104. The user may view the status of the pill being crushed through the side edge 40 of the base 32, the top surface 38 of the base 32, and through the window 66 in the bottom resting surface 36.

After the pill is crushed, the handle 34 can be removed from the base by, in the example shown, unthreading the connection between the handle and the base. The crushed pill may then be emptied from the pill chamber 42.

During the step of crushing, the person can hold the gripping region 100 of the handle 34 to achieve enhanced gripping. In the example shown, this can be done by placing the hand on the handle 34, holding the friction-enhancing portion 102, and placing at least some fingers within the concave recesses 126 separated by the projections 128. Also, during the step of crushing, the person may put the friction-engaging portion 48 of the bottom resting surface 36 in the opposite hand from the hand that is holding the handle 34. Alternatively, the person may put the friction-enhancing portion 48 of the bottom resting surface 36 directly on another surface, such as a table top or counter surface. If holding the base 32 in their hand, the person can grasp the base 32 by placing at least some fingers within the recesses 44 of the base 32.

The method can also include, before the step of placing a pill within the pill chamber 42, removing the lid 138 from the handle 34, removing a pill from the pill holder 140, and then placing the lid 138 back over the access opening 146 of the pill holder 140.

The above is a description of example principles of this disclosure. Many embodiments can be made.

We claim:

1. A method of crushing a pill; the method comprising:

(a) providing a base having:

(i) a bottom resting surface, an opposite top surface, and a side edge between the bottom resting surface and top surface;

(A) the bottom resting surface including an at least partially molded friction-enhancing portion;

(ii) a surrounding wall extending from the top surface; the surrounding wall defining a pill chamber;

(b) placing a pill within the pill chamber;

(c) providing a handle having:

(i) an upper region;

(ii) a gripping region extending from and surrounding the upper region; the gripping region including an integral rigid member with an overmold of at least one of a thermoplastic elastomer or thermoplastic rubber forming an at least partially molded friction-enhancing portion of the gripping region;

(iii) a column having a free end extending from the upper region;

(d) inserting the column into the pill chamber; and (e) crushing the pill by exerting force on the pill by the free end of the column.

2. The method of claim 1 wherein:

(a) the gripping region of the handle includes a plurality of evenly spaced concave recesses separated by a plurality of evenly spaced projections; and the at least partially molded friction-enhancing portion of the gripping region covers substantially all of the evenly spaced concave recesses and evenly spaced projections; and (b) the step of crushing includes holding the gripping region of the handle.

3. The method of claim 1 wherein:

(a) the at least partially molded friction-enhancing portion of the bottom resting surface frames a transparent window in the bottom resting surface; and (b) the method further includes visually inspecting the pill chamber through the transparent window.

4. The method of claim 1 wherein:

(a) the step of crushing includes holding the base against a flat surface with the molded friction-enhancing portion of the bottom resting surface while exerting force on the pill by the free end of the column.

5. The method of claim 4 wherein:

(a) the handle further includes a wall member spaced from and surrounding the column;

(b) the handle and base are constructed and arranged for a threaded connection between: an internal side of the handle wall member; and an external side of the base surrounding wall; and (c) the step of crushing includes rotating the handle to thread into the base and to drive the column into the pill chamber to crush the pill.

6. The method of claim 1 wherein:

(a) the handle includes a pill holder with an access opening in the upper region;

(b) the handle includes a removable lid selectively covering the access opening to the pill holder; and (c) before the step of placing a pill within the pill chamber, removing the lid from the handle, removing a pill from the pill holder, and then placing the lid over the access opening.

7. The method of claim 1 wherein:

(a) the step of providing a base includes providing a bottom resting surface having an integral rigid member with an overmold of at least one of a thermoplastic elastomer or thermoplastic rubber to form an at least partially molded friction-enhancing portion of the bottom resting surface.

* * * * *